United States Patent [19]

Reiss

[11] 4,027,158

[45] May 31, 1977

[54] ELECTROPHOTOGRAPHIC APPARATUS COMPRISING PRE-DEVELOPMENT CHARGE REDUCING MEANS

[75] Inventor: Karl Hans Reiss, Erlangen, Germany

[73] Assignee: Siemens Aktiengesellschaft, Berlin & Munich, Germany

[22] Filed: July 30, 1976

[21] Appl. No.: 710,112

Related U.S. Application Data

[63] Continuation of Ser. No. 507,488, Sept. 19, 1974, abandoned.

[30] Foreign Application Priority Data

Sept. 20, 1973 Germany ..... 2347414

[52] U.S. Cl. ..... 250/315 R; 96/1 C; 96/1 R

[51] Int. Cl.[2] ..... G03G 13/22

[58] Field of Search ..... 250/315 R, 315 A; 355/17; 96/1 C

[56] References Cited

UNITED STATES PATENTS

| | | | |
|---|---|---|---|
| 2,817,765 | 12/1957 | Hayford et al. | 250/315 R |
| 3,117,884 | 1/1964 | Greig | 355/17 |
| 3,784,299 | 1/1974 | Manghirmalani | 96/1 C |

*Primary Examiner*—Alfred E. Smith
*Assistant Examiner*—T. N. Grigsby
*Attorney, Agent, or Firm*—Hill, Gross, Simpson, Van Santen, Steadman, Chiara & Simpson

[57] ABSTRACT

A process and apparatus for the developing of electrophotographic exposures and, more particularly, a process and apparatus for electrophotographic image reproductions. The electrophotographic image-reproducing process and apparatus includes exposing an electrically charged photo-semiconductor layer to dispersed rays for forming a charge image; and rendering said charge image visible, while lowering the base charge between forming of said charge image and rendering the latter visible.

3 Claims, 4 Drawing Figures

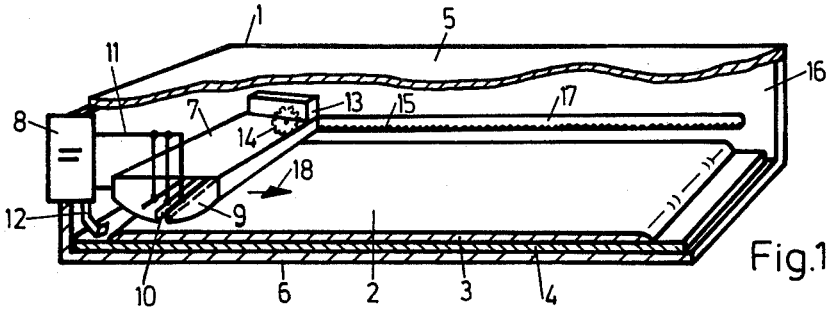
Fig.1
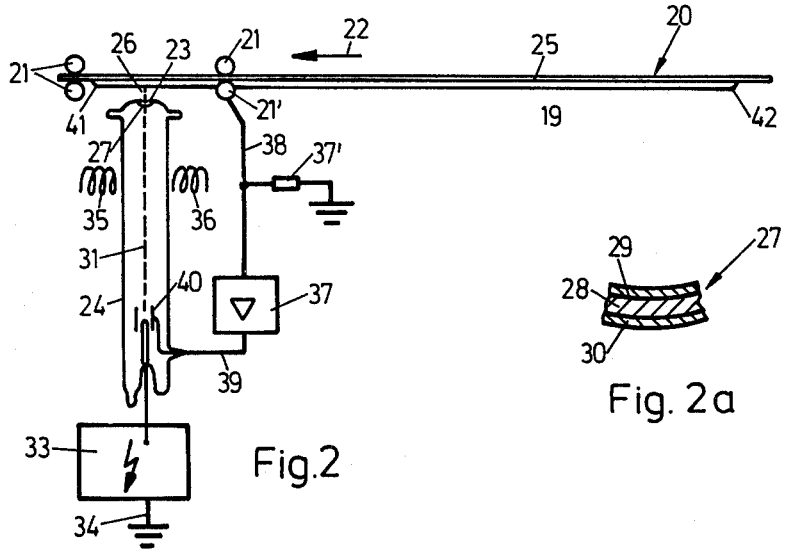
Fig.2
Fig. 2a
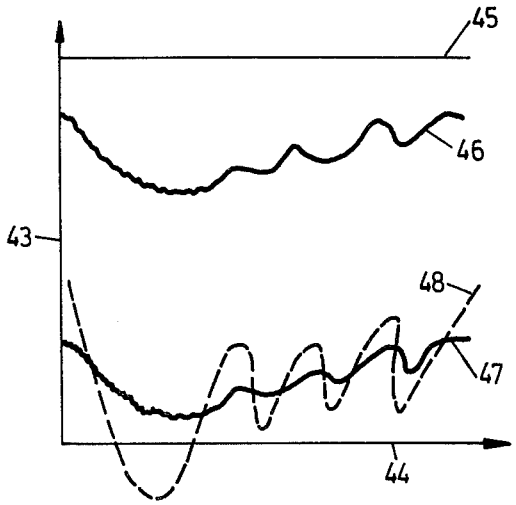
Fig.3

ELECTROPHOTOGRAPHIC APPARATUS COMPRISING PRE-DEVELOPMENT CHARGE REDUCING MEANS

This is a continuation of application Ser. No. 507,488, filed Sept. 19, 1974, now abandoned.

FIELD OF THE INVENTION

The present invention relates to a process and apparatus for the developing of electrophotographic exposures and, more particularly, to a process and apparatus for electrophotographic image reproductions.

DISCUSSION OF THE PRIOR ART

Processes of the above-mentioned type, and apparatus for implementing these processes, are to some extent known from the publication by Boag in Physical Medical Biology (1973), Volume 18, No. 1, pages 3 through 37, under the title "Xeroradiography".

In the known xeroradiographic processes which include photoconductive plates, for example, those formed of amorphous selenium, the surface of the plate is charged either positively or negatively to a high potential (approximately 1 to 3 kV). The thus prepared plate is then exposed to the radiation for effecting the exposure, so as to obtain in the semi-conductive layer a change in the conductivity within the context of the intensity distribution in the image. This results in a corresponding discharge at the exposed or irradiated locations. The thus attained charge image may then be rendered visible by means of various means which are known in xeroradiography (compare, for example, the above-mentioned published article, pages 19 to 23). The most useful is, for example, the coating with a colored pigment which is dependent upon the charge and, in particular, the dusting with a dielectric colored powder.

In layers constituted of selenium which, as a rule, have a thickness of 150 to 300 $\mu$m, and which are applied to a supporting electrically conductive base, for X-ray exposures there are required approximately 30 mR of the customary rays (approximately ICRU 75 kV), even when small quantities of arsonic are added to the selenium for improvement of the sensitivity. This radiation requirement is, however, much too high for exposure in radiographic or penetrating X-rays of patients in contrast with other currently known exposure potentials.

Similarly, the gas systems which are utilized for producing X-ray images require lesser amounts of radiation. In these systems, a thin layer which contains gas, and with respect which there are located oppositely positioned electrodes in the direction of the incoming radiation, inherently comprises a control element corresponding to the semiconductor of the above-mentioned arrangement. Through the incoming rays there are generated ions which wander toward the electrodes. At the electrodes they are then collected on insulating foils. This will produce charge images on the insulating foils, which may be rendered visible, in a manner common to xerography, through dusting with a dielectric colored powder.

For a gas layer which is subjected to a high pressure, approximately 10 atmospheres, and which contains xenon, approximately 3 mR are required for an exposure. In that instance, the primary quantum yield efficiency is of the same magnitude, meaning at 30 to 40 percent, as for the semiconductor layer. The energy requirement for the generation of a charge carrier pair is, however, considerably higher in the gas, approximately 35 eV as compared to approximately 6 for the semiconductor. This again approximately balances itself out, since the charge carrier collection in selenium consists of only approximately 10 percent even for the highest applicable charges. In accordance with the remainder, there are thus produced for a given X-ray input dose at the system, up to a factor having a magnitude of approximately 3, approximately an equal number of charges. The, due to the use of a solid semiconductor layer, much simpler maintained first-mentioned system, thus need not be that much less sensitive as may be assumed.

SUMMARY OF THE INVENTION

Accordingly, it is an object of the present invention to provide a process and an apparatus for the electrophotographic production of X-rays and images by means of photoconductive layers, and in which the sensitivity of image reproduction is considerably enhanced.

The object of the invention is predicated on that the reason for the difference in sensitivity can only lie in the developing process. The semiconductor plate as a rule, in contrast with the base, production of the image, is charged up to 1.5 to 3 kV. During the exposure process, this charge for generating the image is reduced by a few hundred volts. The under-exposed selenium plate in itself is only distinguished from a normally exposed plate through the contrast. The base blackening coincides with a correctly exposed plate. The particles of the dielectric colored powder, which are also designated as toner particles, upon approaching the exposed plate, essentially see the high potential superimposed, such as through eventual auxiliary fields. The toner granules must be so selected that, notwithstanding the high precharge, they still provide an image. In accordance therewith, they may not be too sensitive, in effect meaning, not be too fine-grained, and provided with only a relatively low specific charge.

In contrast therewith, in gas systems used for the filming of X-ray pictures, it is possible to proceed from substantially lower potentials, and mostly even from zero. The charge ranges of the image is built up on an uncharged insulating foil. During developing the charge levels may thus be much easier distinguished. It is possible to, during an eventual time period, meaning during a lengthier dusting period, to achieve a greater extent of blackening or darkening for each charge quantity generated by radiation, as compared with semiconductor plates. The reason for the high degree of sensitivity of the gas system is thus just the magnitude of these relative differences in comparison with the charge of the base.

Also the utilization of auxiliary electrical fields, which are generated by auxiliary electrodes during the developing, in which an electrically preloaded supply electrode is positioned opposite the selenium plate, does not provide the desired increase in the sensitivity. The auxiliary electrodes require a very small spacing from the selenium surface, which is approximately of the magnitude of the desired resolution potential, inasmuch as not only the field intensity, but also the potentials are determinative of the development. This is, however, attainable for large surfaces only with great difficulty, or may be impossible, due to the mechanical tolerances.

The above-mentioned object is inventively solved herein, in that the charge on the base is reduced during the interval between the exposure of the charge image and rendering the latter visible. In that manner, a charge range which corresponds to the image is obtained in an at least approximately chargeless or low charged environment, as is the case in gas systems. There is obtained a comparable degree of sensitivity while employing a solid plate, in effect, there is no need for a surface-forming gas volume between precisely mutually positioned electrodes, and there is no need for a particular gas atmosphere, for example, one which is under a high pressure.

In order to reduce the charge, all of the installations are adapted so that the surfaces thereof are covered equally with charges. A suitable installation or apparatus for carrying out the process according to the invention may consist of an ion generator, from which the particles which are charged oppositely to the charge on the plate, effect a reduction in the base charge. For this purpose, the exposed exposure plate is subjected to an electrical field in which the ions, whose valances are opposite to the charge, are accelerated against the plate. In the case of a positive charge of the selenium plate this is, in effect, by means of negative ions or electrons. The source may be provided a gap which extends in parallel with one edge of the plate. The source may then be conveyed at a small distance above the selenium plate on which there is located the charge range of the image. Since the distance determines the resolution, it should be approximately 0.03 to 0.07 mm when it is desired to obtain the resolution for the usual type of X-ray pictures or exposures. If care is exercised that the field strength always remains within the saturation value of the discharge region of the source selenium plate, the current of each surface element remains constant and independent of the charge. In this instance, if for each unit of time, the same quantities of charges for each unit of surface always flows onto the selenium plate, then the charges at all points of the plate are reduced by the same potential value. Through control of the mechanical movement of the source and its current output, one is thus in the position to reduce the charge level of all points of the selenium plate by the same value. Suitably there is sought thereby a potential distribution whose lowest value lies so far above the zero point so that, with known assurance no image reversion is obtained.

Measuring installation for determination of the surface charges are, for example, constituted of oscillating condenser instruments. It becomes thereby possible to achieve optimum reductions of the potentials, inasmuch as the measurement is connected with the potential through known electronic means, and whereby the potential is maintained constant. For effecting the distribution of the ions which are employed for the reduction of the base charge, the source may be maintained stationary and the plate moved. The only criterion is that the charged particles are uniformly distributed.

As the sources for generating of ion streams there may be utilized corona-lengths with auxiliary electrodes. It is also possible to utilize radioactive materials for the ionization.

A suitable electron source further may be a scanning electron beam. That type of sources are, for example, high-vacuum tubes in which the electrons are generated and then accelerated. A window, which is formed of a thin foil of berylium, aluminum or the like, is provided for the egress of the electrons from the tubes. Also applicable are windows which are formed of materials reacting with electrons, such as a berylium foil having a thickness of a few tenths of millimeter, which carries a coating on the inner surface of the tube, on which the electrons are converted into X-rays. These rays penetrate through the layer of berylium, on the outer surface of which there is provided a layer which converts X-rays into electrons, so that the energy which is conveyed through the aperture in the form of X-rays, exteriorly again becomes available in the form of an electron beam. Both conversion layers may be constructed, for example, of a coating of platinum, gold or any other heavy-metal, having a thickness of approximately 1 to 3 $\mu$m. The aperture in itself may have the form of a strip whose length generally corresponds to the width of the xero plate, while the electron beam may be displaced in a scanning to-and-fro movement. The exposed xero plate is moved past the aperture at a close distance therefrom so as to obtain the desired coating of electrons. As in the previously mentioned arrangement, in this instance also, in lieu of the plate, the tubes may be moved.

Subsequent to the inventive discharging process, which may be carried out in a structure associated with the developing apparatus, or an apparatus ahead of the foregoing, such as in a special cassette, the charge image is developed. This may be carried out in accordance with a desired developing process, as may be known from ionography or xerography (compare, for example, the above-mentioned publication, and particularly page 19).

BRIEF DESCRIPTION OF THE DRAWING

Reference may now be had to the following detailed description of an exemplary embodiment of the invention illustrating the advantages thereof, and taken in conjunction with the accompanying drawings; in which:

FIG. 1 illustrates, partly in section, a cassette which is provided with a corona-discharge unit for carrying out the process according to the invention;

FIG. 2 illustrates an arrangement in which the charge equalization is effected by means of an electron beam tube;

FIG. 2*a* illustrates an enlarged fragmentary detail of the electron outlet window in the tube employed in the arrangement of FIG. 2; and FIG. 3 is a graphical plot of the operative effect of the invention as represented by the charge plotted against position.

DETAILED DESCRIPTION

Referring now in detail to FIG. 1 of the drawing, a cassette 1 has an exposure plate 2 therein, on which there is provided as a suitable exposure layer a 300 $\mu$m thick selenium layer 3 supported on a carrier layer formed of 2 mm thick aluminum sheet. The plate 2 is located behind a ray-penetrable cover 5 which is formed of aluminum, and extends in parallel therewith along floor 6. Located in parallel to one of the edges of the rectangular plate 2 is positioned a gap electrode 7 of a known corona discharge unit. The foregoing is operated by a direct current of 6 kV from a current source 8. Thereby, the gas which is contained in chamber 9, such as air under atmospheric pressure, is ionized. The thus obtained ionized particles of the air diffuse through the gap 10 onto the surface of layer 3, spaced therefrom by a distance of 0.05 mm. Through this manner, the base charge, which is prior to the exposure applied to the plate in a manner known in the xerography, and which has a magnitude of 1.5 to 3 kV, is neutralized, down to a residual in which the alteration of the charge is located as generated by the exposure. So as to achieve a uniform equalization of the base charge at all locations, and the image-wise distribution of the alteration is not disturbed, a motor 13 is positioned at the rear end of the electrode 7, which by means of gear 14 (illustrated in chain-dotted lines) operatively engages gear rack 15, the latter of which is positioned in a groove 17 in rear side wall 16. Similarly, in the front wall of cassette 1, which has been removed in FIG. 1 for purposes of clarity, there is formed a corresponding guide groove for the stable conveyance of the electrode 7. Thusly, by means of this electrode 7, which may be uniformly moved across plate 2 in the direction of arrow 18, the neutralizing charge may be evenly distributed. After the equalizing of the charges, there follows, in a known manner, the conveyance of the plate 2 into a developing unit, the latter of which may be constructed in accordance with the previously mentioned publication, page 19. Therein is formed a visible picture from the charge image. The operation of the invention is ascertained from the above-described and with respect to FIG. 3 further detailed manner.

The arrangement pursuant to FIG. 2 is located in a not in detail disclosed light-tight sealed chamber, in order to prevent any additional exposure of the sensitive layer 19 on plate 20, which corresponds to that shown in FIG. 1 and designated therein by reference numeral 2. The plate 20 is moved between rollers 21, in the direction of arrow 22, past the gap 23 of tube 24. The rollers 21 and 21' only engage the carrier 25 of plate 20 so as to protect the selenium layer 19. The tube 24 is so constructed that the length of the gap 23 corresponds to the width of the plate 20 measured transversely of the longitudinal direction of movement, so that the entire surface of the layer 19 can be covered with the electrons from the beam 26 illustrated in chain-dotted lines. The electron outlet window 27 which closes the gap 23 in a vacuum-tight manner is formed by a layer arrangement which consists of a suitable window layer 28, a 0.2 mm thick beryllium sheet, which is covered on both sides thereof with, respectively, a layer 29 and 30 of platinum having a thickness of 2 $\mu$m (compare with FIG. 2*a*). In this layer, which is shown in FIG. 2*a* in an enlarged cross-section, through the electrons 31 there is effected at the inner platinum layer 30 a conversion into X-rays-which penetrate readily outwardly through the layer 28 of beryllium. At the other surface, electrons are again produced from the X-ray beams in platinum layer 29. These electrons are then transmitted in a beam 26 from the source 33 onto the layer 19, due to the high voltage of approximately 200 kV applied to the layer across the ground contact 34. The beam 31 is then displaced along window 27 in a scanning to-and-fro movement through the arrangement, the latter of which is symbolized by coils 35 and 36, so that the entire width of plate 20 is traversed. In this connection, the scanning is so adjusted that each image point is exposed to electrons for a time period of 0.5 msec. At a focal point of 50 $\mu$m and a voltage of 20 kV, for an electron beam of 0.1 mA strength there is produced a current of 0.1 $\mu$A in the beam 26. In the above-mentioned focal point, there is thus achieved a current density of $5 \times 10^{-4}$A/cm$^2$. Thus for the above-mentioned dwelling time, a surface capacity of $10^{-10}$F/cm$^2$ is charged over. This signifies that, notwithstanding the poor degree of efficiency of the double conversion in the window 27, an extremely rapid reduction of the base charge of plate 20 becomes possible. By means of amplifier 37 which lies, through the intermediary of conduits 38 and 39, between the electrically conductive rollers 21' which are located on the plate 20, and the Wehnelt cylinder 40, due to the measuring resistance 37' which is located between conduit 38 and ground, there may be carried out in a known manner control of the electrons in the beam 26 which are transmitted onto plate 20. Thereby, for example, the charge in the electron beam 26 transmitted onto the surface of layer 19 may be maintained constant since, at each instance, the impinging beam 26 is measured and adjusted through the Wehnelt cylinder 40. Through suitable other adjustments of the operation of the amplifier 37, there may, however, also be obtained a variation in the modulation transmission function of the system. A contrast increase is achieved, for example, when the amplifier 37 is so set that at image points in which the scanning beam 26 impinges against a low potential of the plate 20, there follows an excessively increased equalization of the charge, and at points of higher potential a correspondingly much too low equalization. If this process is reversed, there is obtained a leveling off of the potential differential, meaning, that the contrast of the exposure is reduced. However, other only approximately partial variations of the contrast are adjustable. Thus, for example, rough contrast may be more strongly balanced in favor of fine contrasts, in which the beam 26 is variably influenced in dependence upon a variation in the potentials of the image points.

The selected representation, as shown in FIG. 3, shows in a reduced scale the charge range which is produced on the plate 19 in a line extending between the edges 41 and 42 through an exposure on the surface of the layer 19. In that case the ordinate 43 represents the charge and the abscissa 44 the location, in effect, the distance from edge 41. The horizontal line 45 represents the base charge on plate 20. At an exposure, through a change in the electrical conductivity of the layer 19, the charge of the intensity of the image points is correspondingly partially discharged. This leads to a charge distribution in accordance with curve 46. The foregoing fully corresponds during its cycle with the curve 47. If only the absolute condition, meaning, the charge levels, are different from each other by a single amount. The difference which is indicated between the two curves 46 and 47 is the amount which is inventively carried out by the level reduction of the charge. From the foregoing, however, it is ascertained that the oscillations, which are shown by the curves 46 and 47, drop off in curve 46 relative to the total charge to a lesser extent then in the curve 47, in which the total charge, in comparison with the position, is lower than that of curve 46. The chain-dotted illustrated curve 48 is obtained through the above-mentioned contrast increase. Thereby, the image points of lower potentials are more strongly and such high potentials are less strongly equalized. The peaks and depths of the curve 46, upon transition into the curve 48, reach greater distances from each other.

Although the advantages of the invention, as above-mentioned, are primarily of importance in the generation of penetrating or radiological images with X-rays and similar penetrating beams, they may also be advantageous in the generation of visible or light images. Thus, there may be obtained greater $\Delta U/U$, in which $\Delta U$ signifies the potential difference between two particular points, and U the median potential.

While there has been shown what is considered to be the preferred embodiment of the invention, it will be obvious that modifications may be made which come within the scope of the disclosure of the specification.

What is claimed is:

1. In an apparatus for electrophotographic image reproduction including means for exposing an electrically charged photo-semiconductor layer to dispersed rays for forming a charge image; means for reducing the charge on the layer prior to development; and means for rendering said charge image visible, the improvement comprising; said second-mentioned means including corona disharge means having a bar-like electrode; said bar-like electrode having a gap extending along the longitudinal direction of said electrode; and a cassette containing said electrode, said electrode being movable transversely of a side edge of a plate supporting said semiconductor layer.

2. In an apparatus for electrophotographic image reproduction including means for exposing an electrically charged photo-semiconductor layer to dispersed rays for forming a charge image; means for reducing the charge on the layer prior to development; and means for rendering said charge image visible; the improvement comprising: said second-mentioned means including an electron beam tube for lowering the charge on said semi-conductor layer, said beam tube having a strip-like electron outlet window adapted to be scanned along the length thereof by said electron beam, said window being located in a light-sealed chamber and extending along one edge of said plate, said tube and said plate being mutually displaceably supported transverse to the length of said electron outlet window.

3. An apparatus as claimed in claim 2, comprising measuring and control means connected to said electron beam tube for controlling the intensity of said electron beam.

* * * * *